United States Patent [19]

Rommerswinkel

[11] Patent Number: 4,772,317

[45] Date of Patent: Sep. 20, 1988

[54] HIGH ALLOY STEEL MAKING

[75] Inventor: Heinrich-Wilhelm Rommerswinkel, Muehlheim, Fed. Rep. of Germany

[73] Assignee: Mannesmann AG, Duesseldorf, Fed. Rep. of Germany

[21] Appl. No.: 1,530

[22] Filed: Jan. 8, 1987

[30] Foreign Application Priority Data

Jan. 16, 1986 [DE] Fed. Rep. of Germany ..... 3601337

[51] Int. Cl.[4] ..... C21C 7/00

[52] U.S. Cl. ..... 75/51.1; 75/46; 75/58

[58] Field of Search ..... 75/58, 51.1, 46

[56] References Cited

U.S. PATENT DOCUMENTS 3,791,819 2/1974 Loutzenhiser ..... 75/46

3,985,549 10/1976 Rheinlander ..... 75/46

*Primary Examiner*—Peter D. Rosenberg

*Attorney, Agent, or Firm*—Ralf H. Siegemund

[57] ABSTRACT

The process includes two major phases, each including a converter blowing step and a discharge step, whereby the first discharge step is also a preparatory step for the second blowing step. The steel is dephosphorized, desulfurized, and decarbonized under formation of basic slag which is retained in the converter during the first discharge. Lime, limeflux and possibly clay is added prior to the second blowing together with, preferably, silicon for deoxidation. After the second discharge, additional alloy components may be added.

5 Claims, No Drawings

HIGH ALLOY STEEL MAKING

BACKGROUND OF THE INVENTION

The present invention relates to the manufacture of high-alloyed steel particularly steel having a relatively high content in those kinds of elements that are deemed to have a high affinity to oxygen such as Cr, Mn, under utilization of a basic, oxygen blowing converter.

It is known that during the manufacture of steel and under use of oxygen the accompanying and alloying elements of the iron produce a certain amount of slag, particularly during decarbonization and dephosphorization, and that slag production is high if these elements have a higher affinity to oxygen than the corresponding affinity of iron itself.

The manufacture of high-alloyed steel particularly of steel with a high content in Cr and Mn, therefore, cannot be manufactured in an oxygen blowing converter in an economic fashion since the loss in alloying elements is significantly high. For example, steel with an intended Cr content in excess of 3% or an intended Mn content in excess of 2% are preferably made either in an electric furnace or in an. AOD converter.

On the other hand, it has become known through German printed patent application No. 19 53 888 or No. 22 53 480 to manufacture Cr-steel under utilization of oxygen in general. However, in order to cope with the activity of the oxygen it is necessary to dilute the oxygen or to maintain the decarbonization process at a particular (low) speed. Equipment meeting these requirements is complex and expensive. This procedure requires supervision and extensive control of the decarbonization process and is accompanied by a commensurate change in the inert gas content that has been (or is) mixed with the oxygen. The productivity of such an equipment is not very high owing to the intentional delay in the process introduced for reasons mentioned above.

DESCRIPTION OF THE INVENTION:

It is an object of the present invetnion to provide a new and improved method and equipment by means of which high alloyed steel can be economically manufactured in an oxygen blowing converter without encountering the aforementioned difficulties and without any significant loss in alloying components during the blowing process and with emphasis on a high content in alloy elements which have affinity to oxygen larger than the affinity of iron.

It is, therefore, a particular object of the present invention to provide a new and improved method for making high alloy steel with a relatively high content in elements such as Cr, Mn under utilization of a blowing oxygen converter.

In accordance with the preferred embodiment of the present invention it is suggested to provide two major phases of steel making, both including oxygen blowing with subsequent discharge; the first phase includes also a supplemental blending or mixing step following the discharge; the discharge in the second phase may include (and usually will include) a blending or mixing step to adjust the alloy composition to the elements on the final product. In preparation of the first phase a charge is provided that is comprised of iron containing compositions such as scrap iron and/or pig iron as well as slag forming components. This mixture is decarbonated, dephosphorized and desulfurized through oxygen blowing under formation of basic slag. Subsequently, the molten steel is discharged from the converter under retention of the slag in the converter and during the discharge the steel is deoxidized and alloyed under inclusion of new slag forming components such as carbonates, limestone flux, limest, clay or Alumina to obtain a highly basic slag. The amount of additives used to deoxidize (reduce) the steel and including particularly silicon, is higher than necessary to obtain the desired composition, and the amount of alloys is determined in accordance with the residual heat content of the melt following the smelting process. Pursuant to the second phase, the molten material is charged into the (or an) oxygen blowing converter and the steel making is completed towards the desired content of at least one deoxidization component as well as with regard to the requisite final temperature, under possible addition of further alloying components necessary for the final product.

It can, thus, be seen that the inventive method is basically comprised of two main process and manufacturing steps as far as converter operation is concerned. These major steps can be metallurgically described as follows. The utilization of an iron containing charge such as scrap or pig iron and under utilization of appropriate slag forming component establishes in the converter and in a conventional manner a blowing steel process i.e. the steel is decarbonated, dephosphorized and desulfurized under formation of basic slag. The discharge temperature of the melt is maintained within normal limits as far as this kind of process is concerned. The discharged mild steel does not contain any slag but during the discharge process the melt is alloyed and deoxidized. In addition, other slag forming components are added such as lime, clay or lime flux. The amount of alloying depends on the usable heat content of the melt following this melting process. The adding of reaction components for obtaining deoxidation as well as the alloying is controlled in that the concentration of silicon or aluminum should reach a particular level above the value of the specification of the content of the final product.

The thus deoxidized and alloyed smelt is now, in a second major step, charged into a converter; it can be the same converter as before but it is free at that point from oxidizing slag. The heat content of the melt after the first discharge may not be insufficient in order to smelt the entire amount of alloying components of the final product. For this reason, not all alloying components were admixed to the charge and now, in preparation of the second phase, the requisite remainder of the alloying content is added to the converter, there being essentially no limits in terms of quantity. In this case, one will preferably use a bottom flushing converter so that the molten material is agitated during the process. Now the smelt is blown in a controlled manner with oxygen such that the specified requisite amounts for the reaction medium such as Si should not be exceeded on the lower side. This way one makes sure that those elements that do not have a high affinity towards oxygen such as Cr and Mn will not burn off the smelt. In the rare case that the smelt is to be deoxidized exclusively under utilization of aluminum one has to proceed in a corresponding fashion. The desired temperature increase of the smelt is controllable under utilization of combustion of reaction material such as Si or Al which then has to be added at a higher proportion and in accordance with at the requisite temperature increase, to be obtained in a precise fashion in a short period of time.

The discharge for the highly basic slag established during the second phase leads to a neutralization of the acidic acting oxides obtained during combustion of the reaction components. This way it is prevented that the otherwise acidic slag attacks the possibly phosphate containing slag lining in the converter; otherwise the slag becomes enriched with phosphates. If that were to occur the phosphates will be reduced through the deoxidizing bath and that in turn will lead to an undetermined increase in phosphorous content in the melt. However, owing to the foregoing features of the invention, this particular situation is avoided. In addition, this neutralizing feature reduces wear on the converter.

The final adjustment so to speak of the desired composition in terms of alloying components including those elements which participate in the reaction, is carried out in the final discharge or subsequent ladle treatment. In case a combined Al-Si deoxidation is required then owing to the higher oxygen affinity of aluminum as compared with Si it is necessary to separate these processes and to provide for the Al deoxidation during the second discharge.

The invention offers the following advantages: (1) on account of biparting the overall method into two phases or stages one can maintain the discharge temperatures within tolerable limits, even for a higher alloyed content, and even if a rather hot finishing treatment of the melt is needed. (2) A low P content can be maintained without problems even though such a low P content seems to conflict generally with a the higher temperatures needed for dissolving the otherwise large amounts in alloying components. Also, the presence of large quantities of components which have a high affinity to oxygen opposes the formation of a relatively low P content under normal circumstances or was in the past made possible only while accepting high losses of these elements.

The following exemplary preferred embodiment of practicing the best mode of the invention will be explained.

TASK

A steel having, in addition to iron and normal impurities, the following content is to be made: (all %-s by weight) C between 0.1 and 0.15%; Si between 0.2 and 0.3; Mn between 0.5 and 0.6; less than 0.025% P; less than 0.02% S; between 9.5 and 10 Cr; between 0.005 and 0.025 Al.

FIRST PHASE BLOWING 185 tons of raw (pig steel), iron with a composition of 4.3 C; 0.52% Si; 0.34% Mn; 0.09% P and 0.025 % S, are charged at a temperature from 1350 degrees C. into an oxygen blowing converter adjusted for basic (chemically) operation together with 10 tons of lime and 35 tons of scrap iron. The blowing oxygen amount was 10500 $Nm^3$, the following intermediate product obtains. In addition to iron there is 0.05% C, no silicon, 0.15% Mn; 0.015% P; 0.01% S; no Cr; discharge T of 1730 degrees C.

FIRST DISCHARGE

This material is slag-free as discharged from the converter and into a redistributing decanting ladle while adding 8.0 tons FeCr (0.1% C; 80% Cr); as well as 3.5 tons FeSi (75% Si); 4 tons of lime and 5 tons of lime flux. Following the discharge the ladle contains about 200 tons raw steel having an alloying composition of: 0.06% C; 1.22% Si; 0.13% Mn; 0.016% P; 0.018% S; 3.05% Cr; the temperature of the ladle was about 1600 degrees C.

SECOND BLOWING PHASE

The content of the ladle will be returned to the oxygen blowing converter including any slag that may have formed since the discharge after the first blowing phase. During bottom flushing under utilization of a flushing gas, at a throughput of 10$Nm^3$ per minute, 20 tons of FeCr was added (the content being 0.1% C and 80% Cr) as well as 5 tons of lime, the remainder being iron. Under of utilization of 1700 $Nm^3$ oxygen the superfluous Si was formed into slag. The heat generated in this process serves for melting the ferro-chromium and caused a temperature rise of the melt to 1645 degrees C. Following this procedure the metal had assumed the following composition (in addition to iron): 0.12% Cr; 0.18% Si; 0.14% Mn; 0.018% P; 0.019% S; 9.61% Cr. The temperature as stated was 1645 degrees C.

SECOND DISCHARGE

The second discharge was carried out under retention of slag and into a steel pouring ladle under utilization of 1400 kg of Fe Mn (1% C, 82% Mn); 300 kg FeSi (75% Si) and 250 kg of pure Al. The now completed steel as it is poured into the ladle has the following desired final composition: 0.12% C; 0.26% Si; 0.53% Mn; 0.019% P; 0.019% S; 9.6% Cr; 0.018% Al; the remainder being iron.

The invention is not limited to the embodiments described above, but all changes and modifications thereof, not constituting departures from the spirit and scope of the invention, are intended to be included.

I claim:

1. A method of producing high alloyed steel under inclusion of alloying elements having a high affinity to oxygen such as, but not exclusive, Cr and Mn, and under utilization of an oxygen blowing converter comprising the steps of (i) providing a charge that contains iron as well as slag forming components and feeding same into the oxygen blowing converter for decarbonating, dephosphorizing and desulfurizing the charge, by oxygen blowing in said oxygen blowing converter, under formation of basic acting slag and under simultaneous heating of the charge to a discharge temperature;

discharging the molten steel under retention of the formed slag in the converter while simultaneously deoxidizing the steel and adding alloying components to the steel under further inclusion of new slag forming components such as lime flux, lime and/or clay, to obtain a high basic slag whereby the amount of components, serving as reaction material needed for deoxidizing, is larger than necessary for obtaining a desired final composition, the amount of alloy material depending upon the heat content of the melt following the melting process; and (ii) returning the molten and discharged steel to the oxygen blowing converter under inclusion of at least one deoxidizing material for completion of blowing under formation of the requisite final temperature possibly under inclusion of further alloying components.

2. Method as in claim 1 wherein in the step (ii) the converter is bottom flushed for agitating the molten steel.

3. Method as in claim 1 as applied to a Si-Al killed melt; the requisite quantity of Al needed for deoxidation being added to the molten steel following discharge from step (ii).

4. Method as in claim 1 wherein under utilization of Si as reaction medium as per step (i) the amount of Si added during discharge from the step (i) is up to the five-fold amount of the normal deoxidation material.

5. Method as in claim 1 wherein during step (ii) the molten material is added to the converter together with the slag that was formed during and subsequent to the discharging towards the end of step (i).

* * * * *